US006062704A

United States Patent [19]

Holder

[11] Patent Number: 6,062,704

[45] **Date of Patent: *May 16, 2000**

[54] DIRECT/INDIRECT RECESSED WALL SCONCE

[75] Inventor: Gregory Randal Holder, Conyers, Ga.

[73] Assignee: NSI Enterprises, Inc., Atlanta, Ga.

[ * ] Notice: This patent is subject to a terminal disclaimer.

[21] Appl. No.: 09/122,461

[22] Filed: Jul. 24, 1998

[51] Int. Cl.[7] ..... H01J 61/36

[52] U.S. Cl. ..... 362/223; 362/147; 362/307; 362/364; 362/355; 362/347; 362/247; 362/217

[58] Field of Search ..... 362/223, 147, 362/148, 307, 308, 364, 365, 355, 31, 347, 247, 217, 346

[56] References Cited

U.S. PATENT DOCUMENTS 4,551,791 11/1985 Salansky ..... 362/296
5,278,738 1/1994 Illes ..... 362/147
5,669,700 9/1997 Wendel ..... 362/223
5,735,590 4/1998 Kashima ..... 362/31

*Primary Examiner*—Cassandra Spyrou
*Assistant Examiner*—Leo Boutsikaris
*Attorney, Agent, or Firm*—Kenneth E. Darnell

[57] ABSTRACT

Direct/indirect lighting fixtures particularly intended for recessed applications of fluorescent lighting as wall sconces or the like, the lighting fixtures of the invention combine the efficient lighting capabilities of parabolic fluorescent lighting with the aesthetic appeal of indirect lighting to produce a visually appealing effect. The luminaires of the invention combine an arcuate reflector with an illumination source mounted near one end of the reflector with an arcuate diffuser disposed over the illumination source. Both direct and indirect light thus emanates from the luminaire. The diffuser is mounted within the luminaire to mechanical light trap elements located at either end of the diffuser, the light trap elements serving the dual purposes of minimizing light leakage and mounting the diffuser. In one embodiment of the invention, the light trap elements are integrally formed with the reflector by injection molding of a polymeric material.

25 Claims, 4 Drawing Sheets

DIRECT/INDIRECT RECESSED WALL SCONCE

BACKGROUND OF THE INVENTION

1. Field of the Invention

The invention relates generally to direct/indirect luminaire structures and particularly to recessed fluorescent lighting fixtures intended for use as wall sconces.

2. Description of the Prior Art

Lighting hallways as well as other passageways and/or small gathering locations such as office anterooms is readily accomplished in commercial environments through use of wall-mounted sconce fixtures which can be recessed if desired. Such fixtures are particularly useful when configured to utilize fluorescent lamping. While such fixtures are available in the art, a need continues for aesthetically attractive fixtures having light output which corresponds in light output level and quality of illumination with that illumination provided by parabolic troffer fixtures capable of producing direct and indirect lighting. While presently available wall-mounted fixtures are generally effective in accomplishing illumination goals such as wall illumination, a need exists within certain spaces including interior hallways, walkways and the like for a combination of the aesthetic appeal of indirect lighting, for example, with brightness levels greater than previously available with wall-mounted sconces whether or not recessed. The lighting arts thus feel a need for luminaires capable of creating a more "soft" and appealing lighting environment within spaces best illuminated by wall-mounted fixtures while maintaining reasonable system costs. Such lighting should provide balanced brightness with a necessary illumination of both vertical and horizontal surfaces in order to produce a necessary lighting quality and to enhance user satisfaction within the illuminated space. A luminaire is thus desirable which can produce useful lighting levels coupled with the "softness" or aesthetic appeal of indirect lighting. A wall-mounted luminaire having such capabilities would find ready utility in the art by creation of a feeling of spaciousness to users of the space. Such luminaires find greatest utility when exhibiting design features which make an architectural statement additional to creation of visible comfort. While wall-mounted lighting fixtures including recessed fixtures have previously provided a certain utility, the prior art has not previously provided wall sconce luminaire structures capable of both direct and indirect lighting in a fluorescent system and which are capable of creating the visual advantages alluded to hereinabove and especially when considering luminaire appearance. Accordingly, the present invention is seen to provide a direct/indirect wall-mounted luminaire particularly intended for use with fluorescent illumination sources and which is capable of producing the advantages noted herein including desired light levels as well as desired lighting quality at reasonable cost and with exceptional and pleasing aesthetic appearance.

SUMMARY OF THE INVENTION

The invention provides direct/indirect lighting fixtures particularly intended for recessed wall-mounted applications and using fluorescent lamping to provide cost and operational advantages in use environments where the prior art typically does not provide a desirable combination of balanced lighting and aesthetic appeal of which the present lighting fixtures are especially capable. Although wall-mounted, the present lighting fixtures not only provide balanced brightness levels conducive to productive activity, but also an evenness of illumination on both vertical and horizontal surfaces which contributes to the visual comfort of an occupant of a space illuminated with one or more of the present lighting fixtures.

The wall-mounted luminaires of the invention combine an arcuate reflector with an illumination source disposed on one side of the reflector with the illumination source being effectively mounted to the reflector. The luminaire further includes an arcuate diffuser disposed over the illumination source with light from the illumination source which impinges upon the diffuser being partially passed as direct light with a certain percentage of that light being reflected to the surmounting arcuate reflector for reflection into the space to be illuminated as indirect light. A certain percentage of light from the illumination source directly impinges upon the arcuate reflector and is directed into the space as indirect light.

The wall-mounted fixtures of the invention aesthetically complement the ceiling-mounted recessed fluorescent fixtures described and claimed in U.S. patent application Ser. No. 08/901,264, filed Jul. 28, 1997, by the same inventor and assigned to the same assignee, the disclosure of which patent application is incorporated hereinto by reference. The fixtures of the invention also provide lighting performance unsurpassed by conventional wall lighting and especially recessed wall lighting. In the luminaire structures of the invention, diffuser structure is mounted within the luminaire structures to light trap elements located on opposite walls of the luminaire for the dual purposes of minimizing light leakage from the ends of the diffusers and of mounting the diffusers within the fixtures. The light trap elements further mount the diffusers in partially open positions to allow maintenance and relamping.

Accordingly, it is an object of the invention to provide direct/indirect lighting fixtures particularly intended for recessed wall-mounted applications of fluorescent lighting.

It is another object of the invention to provide fluorescent wall-mounted fixtures capable of direct and indirect illumination of vertical and horizontal surfaces within a space to combine the aesthetic appeal of indirect lighting with brightness levels conducive to productive activity.

It is a further object of the invention to provide aesthetically pleasing direct/indirect recessed wall-mounted lighting fixtures having efficient mechanical structure which contributes to both the aesthetic and illumination qualities of the fixtures while producing operational advantages.

Further objects and advantages of the invention will become more readily apparent in light of the following detailed description of the preferred embodiments.

DESCRIPTION OF THE PREFERRED EMBODIMENTS

Figure 1:
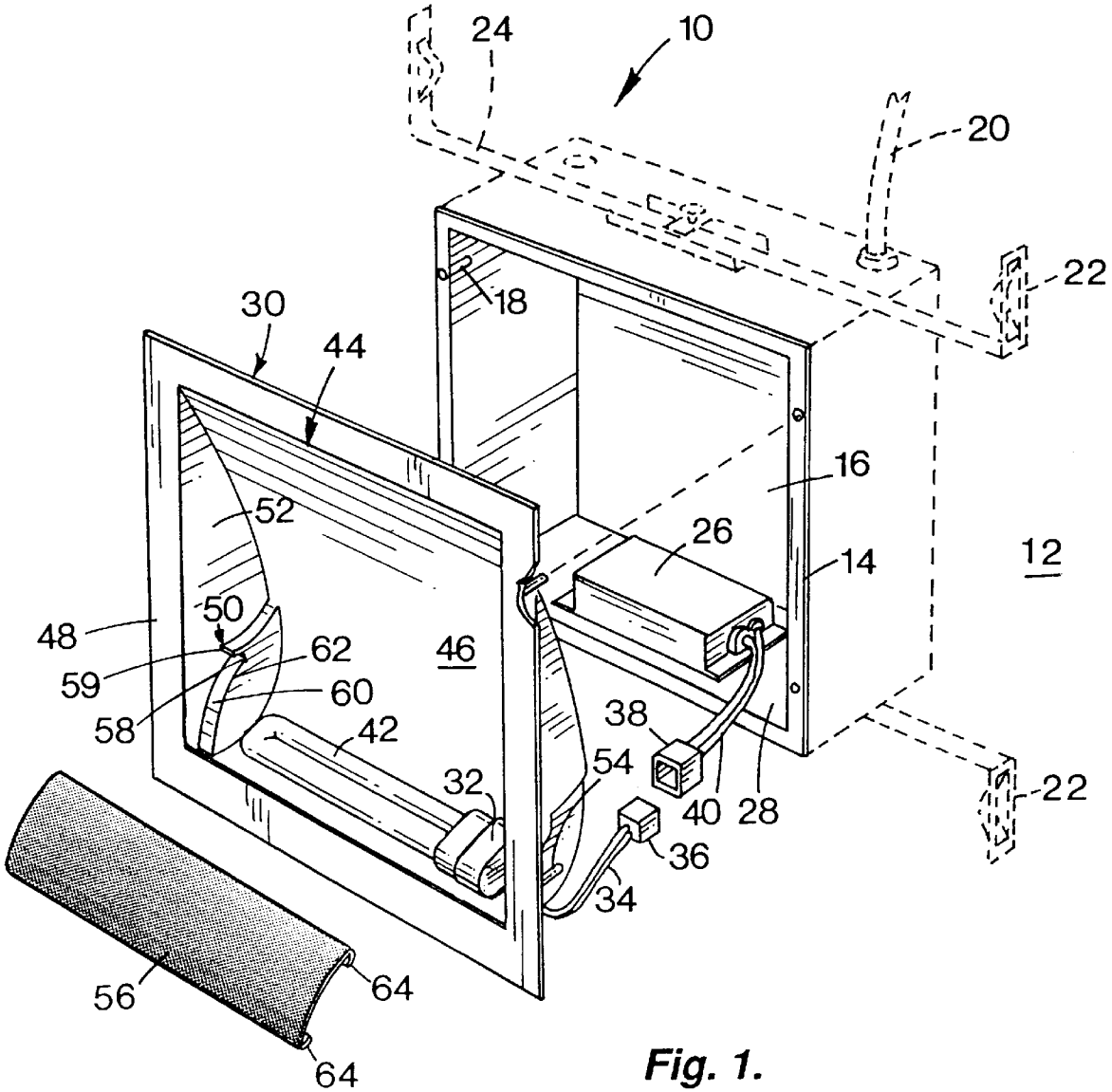
FIG. 1 is a perspective view of a lighting fixture according to the invention shown in an exploded assembly arrangement as in a recessed wall-mounted configuration.
Figure 5:
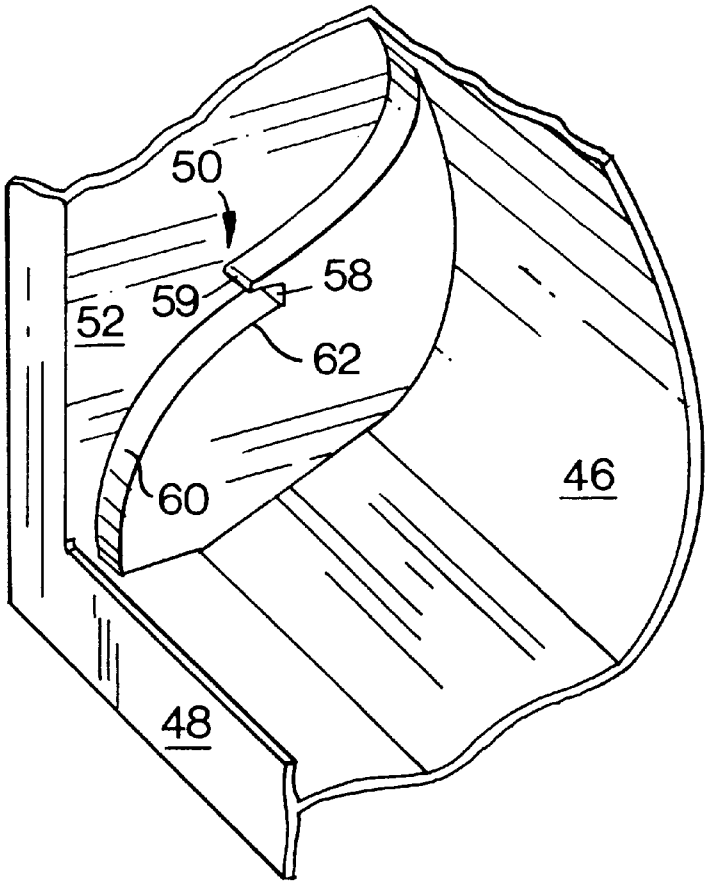
FIG. 5 is a detailed perspective view of the light trap and reflector of the embodiment of FIG. 1; and, FIG. 6 is a side elevational view in partial section of the first embodiment of the invention.
Figure 6:
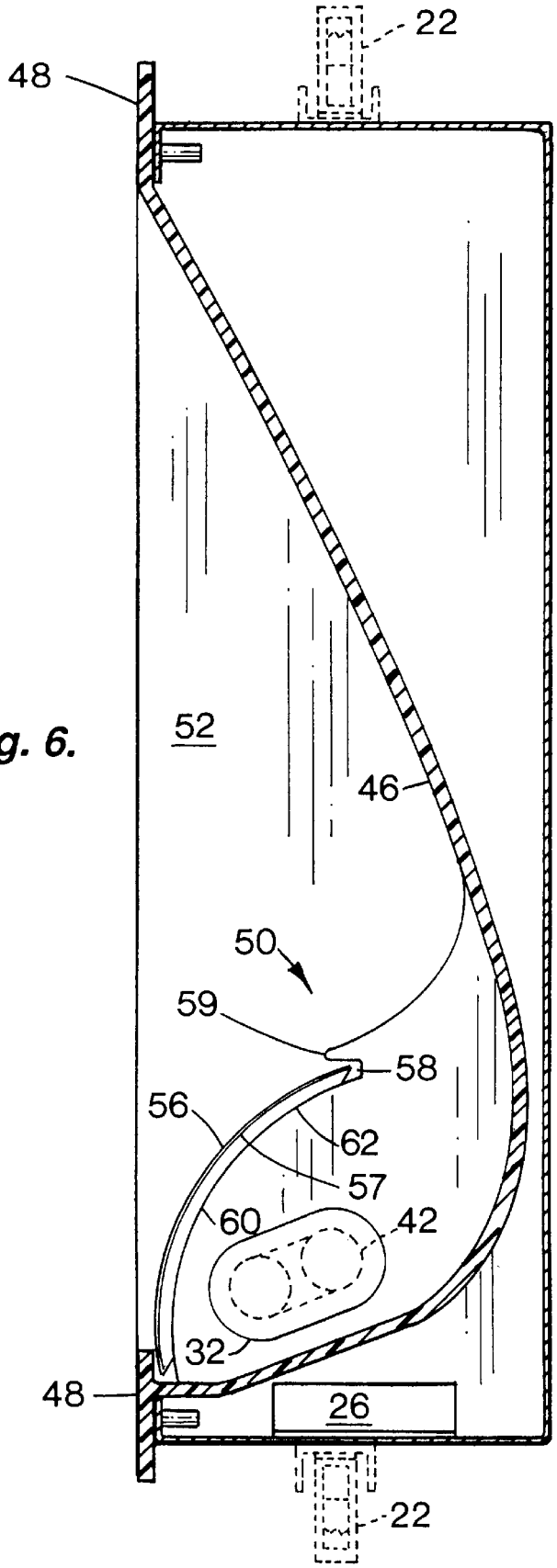

Referring now to the drawings and particularly to FIGS. 1, 5 and 6, a lighting fixture configured according to the invention is seen generally at 10 to comprise a recessed, wall-mounted luminaire. Wall 12 is seen to have a substantially square opening 14 formed therein to receive a "rough-in" box 16 into the opening, outermost edges of the box 16 being substantially flush with the opening 14 and having tubular fastener housings 18 connected thereto for mounting purposes as will be described hereinafter. The "rough-in" box 16 is of conventional structure and is supplied with electrical wiring (not shown) through which power is introduced into the interior of the box 16 through conduit 20 which is conventionally joined to the box 16, the interior of the conduit 20 communicating with the interior of the box 16 through an opening (not shown) in the box 16 at the point where the conduit 20 joins said box 16. The box 16 is mounted between wall studs (not shown) by means of hanger bar assemblies or mounting brackets which are of conventional design. The hanger bar assemblies or brackets adjust relative to each other and relative to the box 16 to allow nailing plates 22 of the bar hanger assemblies 24 to be nailed to the wall studs between which the box 16 is mounted. Appropriate fasteners lock slidable elements of each of the bar hanger assemblies 24 together on installation between wall studs as is also conventional in the art.

Electrical wiring (not shown) extending into the interior of the "rough-in" box 16 through the conduit 20 connects to ballast 26 which is shown mounted to floor 28 of the box 16. It is to be understood that the ballast 26 can be otherwise mounted within the interior of the box 16 such as to the "ceiling" of the box or to either one of opposing side walls. Since the box 16 essentially has a square opening lying in the plane of the wall opening 14, it is possible to configure remaining portions of the lighting fixture 10 to cause light emanating from the fixture 10 to be directed in any one of four orientations depending upon the mounting of reflector unit 30 to the box 16. As is shown in FIG. 1, light is essentially reflected downwardly from the fixture 10. Inversion of the reflector unit 30 in its connection to the "rough-in" box 16 would cause light to be reflected upwardly. Mounting of the reflector unit 30 to one side or the other of the box 16 would cause light to be similarly directed in sidewise directions.

The ballast 26 is seen to be connected to a lamp socket 32 mounted by the reflector unit 30 and connected by wiring 34 to an electrical connector 36. The connector 36 connects to an electrical connector 38 which is connected by wiring 40 to the ballast 26. It is to be understood that the ballast 26, the lamp socket 32 as well as the wiring 34, 40 and connectors 36, 38 are conventional in the art and need not be described herein. The lamp socket 32 is mounted to the reflector unit 30 above an opening (not shown) through which the wiring 34 extends. The lamp socket 32 further mounts a fluorescent lamp 42 at a location of the reflector unit 30 such that the lamp 42 extends across an end 44 of reflector surfaces 46 having the greatest slope. The lamp 42 can preferably be chosen to be a T5 bi-tube fluorescent lamp of a desired wattage such as 40 W or 50 W. It is to be understood that other types of lamps and wattages can be employed. Such lamping is conventionally available from manufacturers such as The General Electric Corporation, Philips, Osram and Sylvania. Such lamping is expected to exhibit a lamp life of from 1200 to 2000 hours depending upon lamp wattage.

The reflector unit 30 is seen to be further configured to have a substantially square perimetric flange 48 formed thereabout, the flange 48 essentially acting to cover the opening 14 formed in the wall 12 on assembly of the reflector unit 30 to the box 16. The flange 48 is formed integrally of a polymeric material such as the material Valox, a proprietary product of The General Electric Plastics Division, the material being chosen for flame retardancy as well as for structural considerations. The entirety of the reflector unit 30 is injection molded in a first embodiment of the invention with the reflector surfaces 46 being arcuate in a manner similar to the arcuate structures of reflectors shown and described in the aforesaid patent application. The reflector surfaces 46 can be formed of a color and finish which will cause said surfaces 46 to be sufficiently reflective to be of great utility in the manufacture of the lighting fixture 10. It is also to be noted that the reflector surfaces 46 can be painted through use of a highly reflective paint in order to produce a desired reflective finish. A light trap and diffuser mount 50 is integrally formed with the reflector unit 30 on each side thereof with one each of the mounts 50 being formed with one each of side walls 52, the side walls 52 completing the structure of the unit 30 by integrally joining with the flange 48 and the body of the reflector surfaces 46. Male portions 54 of a male/female fastening connector are also formed integrally with the reflector unit 30 and are located to be received within the tubular housings 18 mounted to the box 16. It is to be understood that the structure fastening the reflector unit 30 to the box 16 can take a number of different forms consistent with suitable connection of said unit 30 to the box 16. In an assembly situation, the electrical connectors 36 and 38 are connected after rough-in of the box 16 with the reflector unit 30 then simply being attached to the box 16 through use of the fastener comprised of the elements 54 and 18 respectively carried by the reflector unit 30 and the box 16. It is to be understood that the box 16 can be roughed in and allowed to remain until a later time after dusty construction activities have ceased, at which time the reflector units 30 can be installed to the boxes 16 in a given construction environment.

The light trap and diffuser mounts 50 which are integrally formed with the reflector unit 30 mount a diffuser 56 which can take a variety of forms. In particular, the diffuser 56 can be provided with a plurality of slots as illustrated herein and as is shown in the aforesaid patent application. The slots perforate the surface of the diffuser 56 over those arcuate body portions thereof which are visible as seen in FIG. 1. For ease of illustration, the diffuser 56 having slots formed therein is utilized to describe the several embodiments of the invention. However, it is to be noted that a diffuser 56 perforated with round perforations as shown in the aforesaid patent application could be utilized without departing from the spirit and scope of the invention. Still further, a diffuser such as can be formed of a linear prismatic acrylic lens as described in the aforesaid patent application can be used, the essential structures of the several diffusers being identical as to mechanical function. The optical functions of the several diffusers are similar especially as regards the perforations formed of slots or round perforations. The diffuser 56 is preferably provided with a diffusing sheet 57 as is described in the aforesaid patent application. Light emanating from an illumination source, such as the lamp 42, passes through the slots of perforations and directly illuminates a space externally of the fixture 10. A certain percentage of the light incident on interior surfaces of the diffuser 56, that is, that light not passing through the perforations, is reflected against portions of the reflector surfaces 46 and then indirectly reflected into the environmental space. A certain percentage of the light emanating from illumination sources mounted within the fixture 10 directly impinges the arcuate reflector surfaces 46 and is thus reflected into the environmental space as indirect lighting.

While the shapes of the reflector surfaces 46 are arcuate and can be essentially as described in the aforesaid patent application, it is more desirable that the reflector surfaces 46 be formed in a flatter curve with the height thereof being less in relation to the width than is described relative to the reflectors of the fixture shown in the aforesaid patent application. The shape and function of the light trap and diffuser mounts 50 as well as that of the diffuser 56 are very similar to the shape and function of the corresponding structures seen in FIGS. 17 through 19 of the aforesaid patent application. The diffuser 56 is mounted by the two spaced light trap and diffuser mounts 50, the diffuser 56 being mounted in a notch 58 formed in each of the mounts 50, each mount 50 having a tab 59 at one end thereof and being adjacent to the notch 58 to create the notch 58 which receives an end portion of the diffuser 56 thereinto to hold the diffuser 56 to the mounts 50. The shape of the mounts 50 is similar to the shape of the light trap mounting elements 160 of the aforesaid patent application. The diffuser 56 is similar to the shape of the diffuser 158 of the aforesaid patent application with functioning thereof being essentially identical. In the present structure, the other end portion of the diffuser 56 fits between an outer surface of the mount 50 and the flange 58 in the respective ends of the unit 30.

Figure 3:
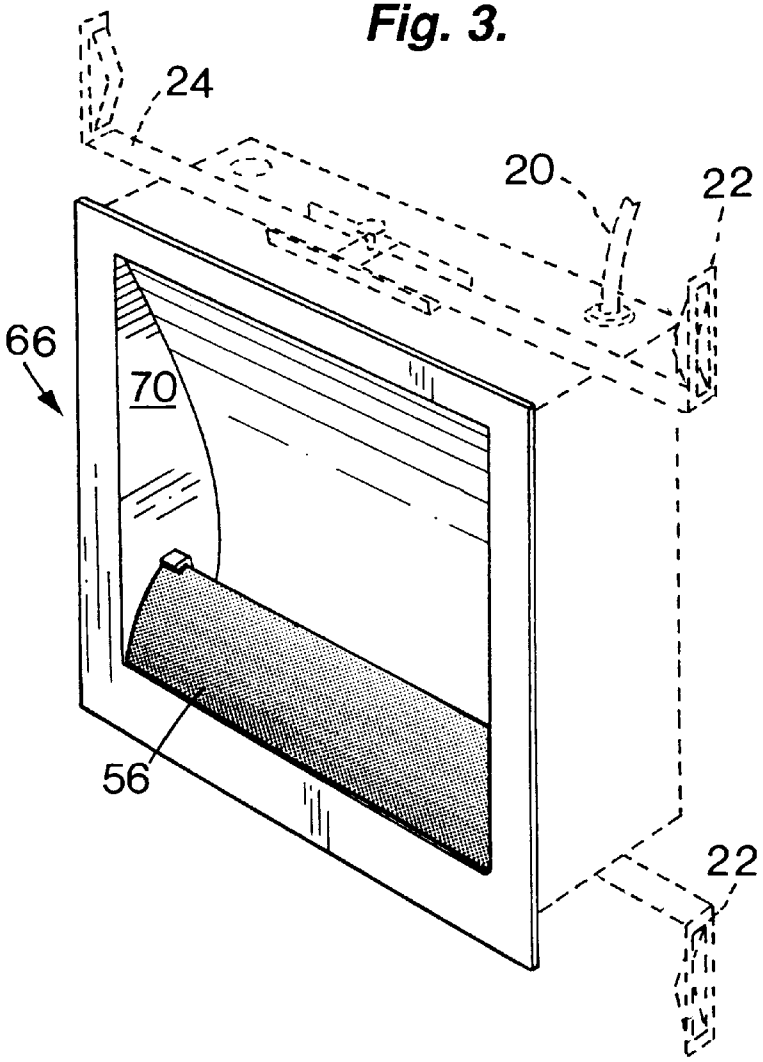
FIG. 3 is a perspective view of the fixture of FIG. 2 having the diffuser assembled in place.
Figure 2:
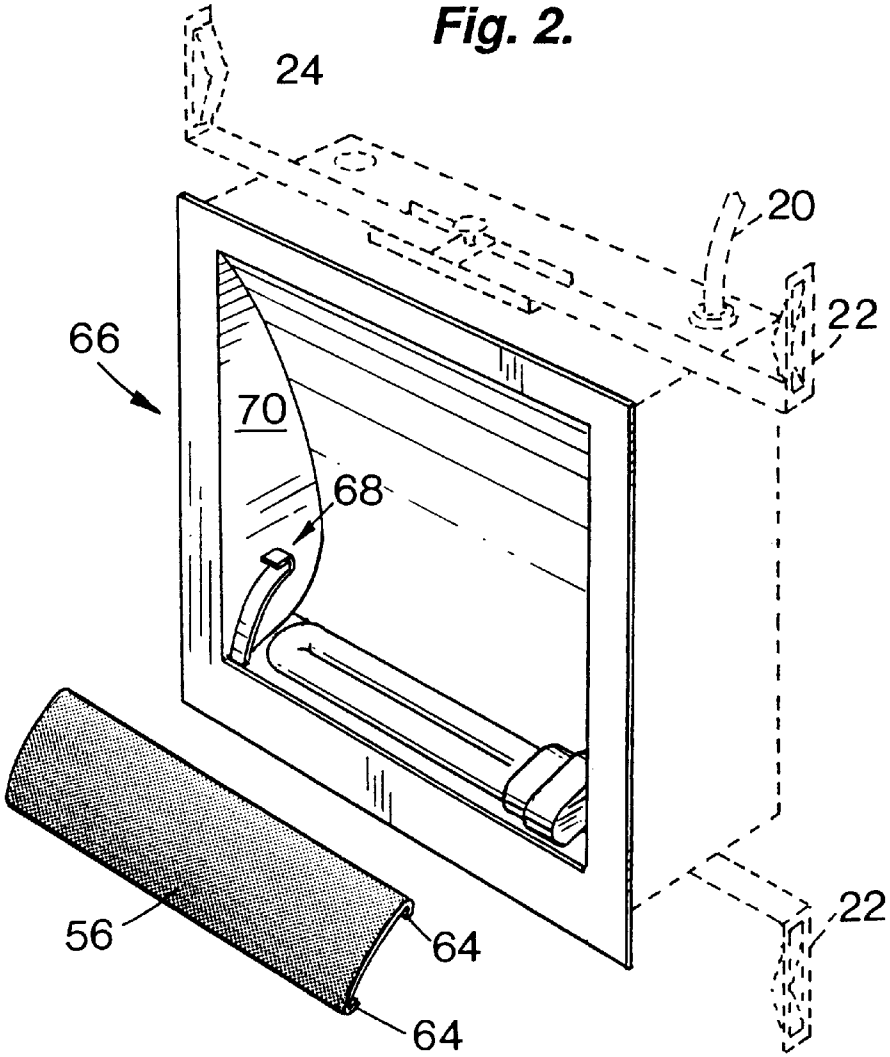
FIG. 2 is a perspective view of a reflector of a second embodiment of the invention mounted to a recessed fixture housing.
Figure 4:
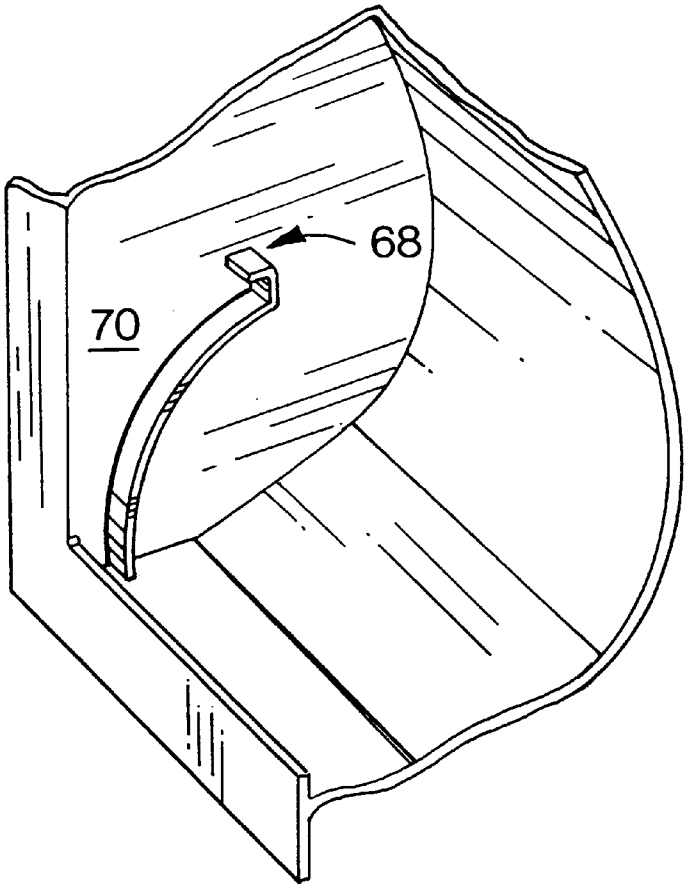
FIG. 4 is a detailed perspective view of the light trap of the embodiment of FIGS. 2 and 3.

The diffusers 56 are essentially identical in function to either embodiment of the invention whether that embodiment of FIGS. 1, 5 and 6 or that embodiment of FIGS. 2 through 4. As will be described hereinafter, the embodiment of FIGS. 2 through 4 utilizes a light trap and diffuser mounting element which can be formed separately from the remaining portions of a reflector unit and separately fixed thereto as will be described hereinafter. In the embodiment of FIGS. 2 through 4, the ends of the diffusers 56 fit about curved mounting flange 60 to provide an effective light trap function and an effective mounting function. The light trap and mounting functions are therefore provided through the use of similar structure when considering the two embodiments of the invention which are explicitly described herein. Mounting flanges 64 of the diffuser 56 in the embodiments of the invention hold the diffusing sheet 56 in place. Particular cross sectional shapes of the diffusers 56 as well as the structure of such diffusers can be taken from the aforesaid patent application as can the contours of the light trap and diffuser mounts 50 inter alia.

Referring now to FIGS. 2 through 4, a second embodiment of the present lighting fixture is seen to comprise a reflector unit 66 which is essentially identical to the reflector unit 30 of FIG. 1 with the exception that the mounts 50 are not integrally molded with said reflector unit 66. In the embodiment of FIG. 2, light trap and diffuser mounts 68 are separately formed and then welded sonically or otherwise affixed in place to side wall 70 of the reflector unit 66. The mount 68 can be formed more simply than corresponding structure found in the aforesaid patent application due to the fact that the mounts 68 are not mounted to the side wall 70 by means of a sliding lock arrangement as is described relative to the primary embodiments of the invention described in the aforesaid patent application. The figures essentially show mounting of the light trap and diffuser mount 68 to the reflector unit 66 with a diffuser, which can be the diffuser 56 of FIG. 1, then being mounted to the mounts 68 as described hereinabove relative to the mounting of the diffuser 56 to the mounts 50 of FIG. 1.

Although the invention has been shown and described for use with lamping of a particular size and type, it is to be appreciated that the lamping can be chosen other than as shown herein. It should further be understood that the lighting fixtures of the invention can be configured with differing dimensions than as expressly shown in the drawings. Accordingly, it is further understood that the invention can be practiced other than as explicitly described and shown herein, the scope of the invention therefore being limited by the recitations of the appended claims.

What is claimed is:

1. A lighting fixture mountable within a recess formed in a vertical wall, at least major portions of the lighting fixture lying within the recess, the lighting fixture illuminating by direct and indirect illumination an interior portion of an environmental space within which the fixture is mounted, comprising:

a housing open over a face thereof, the open face extending toward the interior of the environmental space within which the fixture is mounted for illumination of said space, a plane in which the open face of the housing lies being substantially parallel to a plane in which the wall lies;

a reflector element mounted by the housing and having arcuate reflective surfaces extending from a first lateral edge of the housing and toward a second lateral edge thereof, the reflective surfaces facing the open face of the housing;

a diffuser element mounted in juxtaposition to the second lateral edge of the housing and covering portions of the reflector surfaces located in proximity thereto, the diffuser element being spaced from the reflector element to define an illumination zone within the interior of the housing; and, illumination means for providing light output disposed within the illumination zone, at least portions of the diffuser element being open to direct passage of light therethrough from the illumination means, portions of the light emanating from the illumination means and being incident on the diffuser element passing through the diffuser element and into the environmental space with other portions of the light incident on the diffuser element being reflected by the diffuser element to the reflector element for reflection externally of the fixture, other portions of the light emanating from the illumination means being incident directly on the reflector element and being substantially reflected into the environmental space.

2. The lighting fixture of claim 1 and further comprising means for mounting the diffuser element within the housing, the mounting means comprising means for reducing light leakage from end portions of the diffuser element at junctures with wall surfaces of the housing, the mounting means comprising an arcuate mounting flange having a shape congruent with an arcuate shape of the diffuser element, the diffuser element fitting against and to the arcuate mounting flange.

3. The lighting fixture of claim 2 wherein the diffuser element mounting means and the reflector element are formed integrally with said housing, one of the arcuate mounting flanges being formed on each side wall of the housing.

4. The lighting fixture of claim 1 wherein the wall has an opening communicating the recess with the interior of the environmental space, a rough-in box being disposed within the recess and further comprising means carried by the housing and by the box for coupling together to attach the housing to the box.

5. The lighting fixture of claim 1 wherein the arcuate reflective surfaces are essentially similar to a parabolic shape with a concave portion thereof facing the open face of the housing.

6. The lighting fixture of claim 1 wherein a shielding angle of the fixture is an angle between an uppermost edge of the diffuser element and the second lateral edge of the reflector element and is approximately 23°.

7. The lighting fixture of claim 1 wherein the diffuser element has a plurality of longitudinally disposed slots formed therein.

8. The lighting fixture of claim 1 wherein the diffuser element has a plurality of circular apertures formed therein.

9. The lighting fixture of claim 1 wherein the diffuser element has prisms formed on at least one surface thereof.

10. The lighting fixture of claim 1 and further comprising a diffusing sheet fitted to innermost surfaces of the diffuser element.

11. The lighting fixture of claim 1 wherein the illumination means comprise at least one compact fluorescent lamp.

12. The lighting fixture of claim 1 wherein the illumination means comprise at least one elongated fluorescent lamp.

13. The lighting fixture of claim 1 and further comprising means carried by the fixture for mounting the reflector element at any one of four orientations regularly spaced apart at 90° angles to cause the diffuser element to be located either near a bottom, a top or either of two sides of the fixture.

14. The lighting fixture of claim 1 wherein the reflective surfaces of the reflector element have a radius of curvature which is greater nearmost the first lateral edge of the housing than nearmost the second lateral edge of the housing.

15. The lighting fixture of claim 1 wherein at least portions of the diffuser element are open to direct passage of light therethrough.

16. The lighting fixture of claim 1 and further comprising means for mounting the diffuser element within the housing and comprising means for reducing light leakage from end portions of the diffuser element at junctions with wall surfaces of the housing, the mounting means comprising at least one arcuate mounting flange disposed at one end of the diffuser element and having a shape congruent with an arcuate shape of the diffuser element, the diffuser element fitting against and to the arcuate mounting flange.

17. The lighting fixture of claim 16 wherein the mounting means and the reflector element are formed integrally with each other.

18. The lighting fixture of claim 16 wherein the shapes of the mounting flange of the mounting means and of the portions of the diffuser element fitting thereto are continuously changing curves which are symmetric about a centerline.

19. The lighting fixture of claim 18 wherein the arcuate portions of the shapes are arcs of circles having differing centers and radii, the arcs being joined at adjacent ends thereof and acting to form a concave arcuate shape with end portions thereof each being spaced from a portion of one of the reflector elements.

20. The lighting fixture of claim 1 and further comprising a diffusing sheet mounted to innermost surfaces of the diffuser element.

21. A lighting fixture mountable within a recess formed in a vertical wall, at least major portions of the lighting fixture lying within the recess, the light fixture illuminating by direct and indirect illumination an interior portion of an environmental space within which the fixture is mounted, comprising:

a housing open over a face thereof, the open face extending toward the interior of the environmental space within which the fixture is mounted for illumination of said space;

a reflector element mounted by the housing and having arcuate reflective surfaces extending from a first lateral edge of the housing and toward a second lateral edge thereof, the reflective surfaces facing the open face of the housing;

a diffuser element mounted in juxtaposition to the second lateral edge of the housing and covering portions of the reflector surfaces located in proximity thereof, the diffuser element being spaced from the reflector element to define an illumination zone within the interior of the housing;

illumination means for providing light output disposed within the illumination zone; and, means for mounting the diffuser element within the housing, the mounting means comprising means for reducing light leakage from end portions of the diffuser element at junctures with wall surfaces of the housing, the mounting means comprising an arcuate mounting flange having a shape congruent with an arcuate shape of the diffuser element, the diffuser element fitting against and to the arcuate mounting flange.

22. The lighting fixture of claim 21 wherein the diffuser element mounting means and the reflector element are formed integrally with said housing, one of the arcuate mounting flanges being formed on each side of the housing.

23. The lighting fixture of claim 21 wherein the reflective surfaces of the reflector element have a radius of curvature which is greater nearmost the first lateral edge of the housing than nearmost the second lateral edge of the housing.

24. The lighting fixture of claim 21 wherein the shapes of the mounting flange of the mounting means and of the portions of the diffuser element fitting thereto are continuously changing curves which are symmetric about a centerline.

25. The lighting fixture of claim 24 wherein the arcuate portions of the shapes are arcs of circles having differing centers and radii, the arcs being joined at adjacent ends thereof and acting to form a concave arcuate shape with end portions thereof each being spaced from a portion of one of the reflector elements.

* * * * *